US007575438B2

(12) United States Patent
Dilgard

(10) Patent No.: US 7,575,438 B2
(45) Date of Patent: Aug. 18, 2009

(54) TRAILER TOWING CONNECTOR WITH LIGHTING CIRCUIT GROUND PATH

(75) Inventor: David Dilgard, Phoenix, AZ (US)

(73) Assignee: U-Haul International, Inc., Phoenix, AZ (US)

( * ) Notice: Subject to any disclaimer, the term of this patent is extended or adjusted under 35 U.S.C. 154(b) by 40 days.

(21) Appl. No.: 11/711,557

(22) Filed: Feb. 26, 2007

(65) Prior Publication Data

US 2007/0202711 A1 Aug. 30, 2007

Related U.S. Application Data

(60) Provisional application No. 60/776,288, filed on Feb. 24, 2006.

(51) Int. Cl.
*H01R 33/00* (2006.01)

(52) U.S. Cl. ..... 439/35; 439/490

(58) Field of Classification Search ..... 439/35, 439/36, 490, 620.04
See application file for complete search history.

(56) References Cited

U.S. PATENT DOCUMENTS

| | | | | |
|---|---|---|---|---|
| 4,405,190 | A * | 9/1983 | Schroeder | 439/503 |
| 4,969,834 | A * | 11/1990 | Johnson | 439/141 |
| 5,388,357 | A | 2/1995 | Malita | |
| 5,463,280 | A | 10/1995 | Johnson | |
| 5,936,599 | A | 8/1999 | Reymond | |
| 6,177,865 | B1 * | 1/2001 | Bryant et al. | 340/431 |
| 6,411,045 | B1 | 6/2002 | Nerone | |
| 6,796,698 | B2 | 9/2004 | Sommers et al. | |
| 6,911,915 | B2 | 6/2005 | Wu et al. | |
| 7,008,088 | B2 | 3/2006 | Pisciotti | |
| 2005/0265039 | A1 * | 12/2005 | Lodhie et al. | 362/541 |
| 2006/0083012 | A1 | 4/2006 | Ter-Hovhannissian | |

OTHER PUBLICATIONS

Website pages: http://www.etrailer.com/y-226.aspx, "LED Lights", etrailer.com, printed on Sep. 26, 2006 (10 pages).

* cited by examiner

*Primary Examiner*—Tho D Ta
*Assistant Examiner*—Travis Chambers
(74) *Attorney, Agent, or Firm*—Tiffany & Bosco, P.A.

(57) ABSTRACT

An apparatus provides for coupling a trailer lighting circuit including a light emitting diode to towing vehicle lighting circuit. The apparatus includes a connector having a first contact for coupling to a trailer lighting circuit input and a second contact for coupling to an electrical ground. The connector includes a resistive component coupled between the first contact and the second contact. The connector is configured to couple the first terminal to an output of the towing vehicle lighting circuit. The resistive component can include a resistor, an incandescent light or another component having suitable electrical resistance. The connector can be in various forms, including a trailer harness plug, a towing vehicle harness plug, or an adapter for coupling a towing vehicle electrical harness plug to a trailer electrical harness plug.

18 Claims, 5 Drawing Sheets

TRAILER TOWING CONNECTOR WITH LIGHTING CIRCUIT GROUND PATH

RELATED APPLICATION DATA

This application is based on and claims the benefit of U.S. Provisional Patent Application No. 60/776,288 filed on Feb. 24, 2006, the disclosure of which is incorporated herein in its entirety by this reference.

BACKGROUND

This invention relates generally to vehicle electrical systems for trailer towing connection. More particularly, it relates to such a system that includes a connector with a lighting circuit ground path to allow for operation with LED trailer light circuits.

LED (Light Emitting Diode) lights have become popular on motor vehicles and trailers because they are longer-lasting and more energy-efficient than traditional incandescent lights. Certain vehicle electrical systems that are provided for trailer connection, however, function when connected to an incandescent trailer light circuit, but do not function when connected to an LED trailer light circuit. These vehicle systems sense connection to electrical ground through an incandescent trailer light circuit, and are thereby prompted to provide power for operation of trailer lights. These systems do not sense connection to ground in LED trailer light circuits, and therefore do not energize, and do not energize trailer lights.

There is a need, therefore, for an apparatus that will prompt towing vehicles not presently compatible with LED trailer lights to provide normal operational interface with trailers having LED lights. It is an object of the present invention to provide such an apparatus.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, there is provided an apparatus for coupling a trailer lighting circuit including an LED to towing vehicle energizing circuit. The apparatus includes a connector having a first contact for coupling to a trailer lighting circuit input and a second contact for coupling to an electrical ground. The connector includes a resistive component coupled between the first contact and the second contact. The connector is also configured to couple the first terminal to an output of the towing vehicle energizing circuit.

According to another aspect of the invention, there is provided an apparatus for coupling a towing vehicle electrical harness to a trailer electrical harness that is coupled to a trailer light having an LED. The apparatus includes connector means for electrically coupling the towing vehicle electrical harness to the trailer electrical harness. The connector means includes a resistive component that is coupled in parallel with the trailer light when the connector means is coupled to the towing vehicle electrical harness.

According to still another aspect of the invention, there is provided an apparatus for coupling a towing vehicle energizing circuit for energizing an incandescent trailer light to a light emitting diode on a trailer. The apparatus includes a connector for electrically coupling the towing vehicle energizing circuit to the light emitting diode. The connector has a first terminal for connecting to an electrical ground, a second terminal for coupling to the light emitting diode and a resistive component coupled between the first terminal and the second terminal. The trailer light emitting diode is electrically coupled between the first connector terminal and the second connector terminal when the connector is coupled to the light emitting diode.

The resistive component described above can include a resistor, an incandescent light or another component having suitable electrical resistance. The connector can be in various forms. These forms can include, for example, a trailer harness plug, a towing vehicle harness plug, or an adapter for coupling a towing vehicle electrical harness plug to a trailer electrical harness plug.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred methods and embodiments given below, serve to explain the principles of the invention.

DETAILED DESCRIPTION

Figure 1:
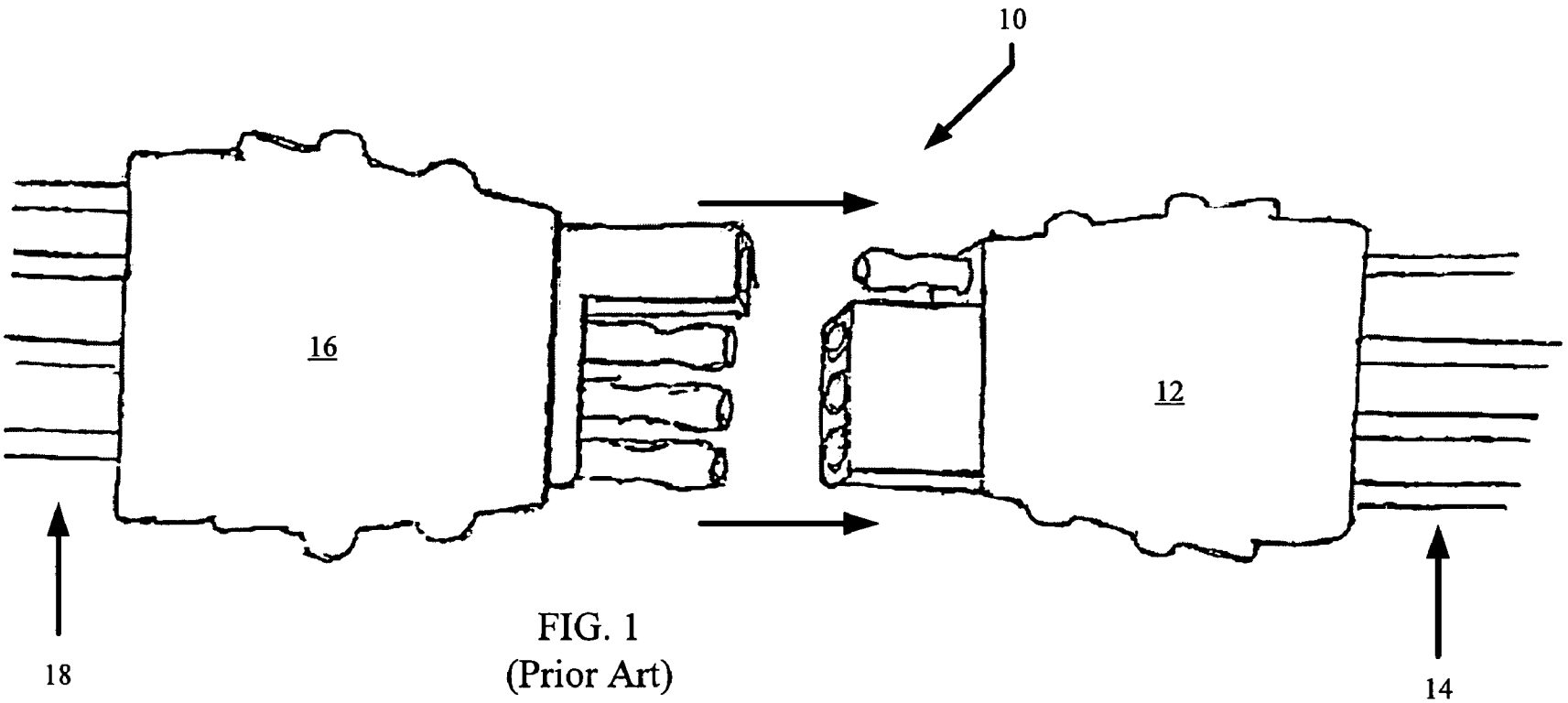
FIG. 1 (Prior Art)
FIG. 1 shows a typical connector assembly known in the prior art for coupling a towing vehicle electrical harness to a trailer electrical harness.

FIG. 1 shows a typical configuration of a trailer towing electrical connector assembly for connecting the electrical systems of a towing vehicle and a trailer is shown. The connector assembly 10 includes a towing vehicle plug 12 attached to a towing vehicle electrical harness 14 and a mating trailer plug 16 attached to a trailer electrical harness 18. There are a number of different plug configurations commonly in use, including 4-pin, 5-pin, 6-pin, or 7-pin plugs. The number of pins (terminals) determines the number of individual circuits that can be controlled. It often happens that one wishes to connect a towing vehicle having one configuration of plug to a trailer with a different configuration of plug. For this purpose, adapters, such as 7-round to 4-flat, 7-round to 6-round, 6-round to 4-flat, and many other configurations are readily available.

The present invention introduces a resistive grounding component, such as a resistor or a small incandescent light, into individual trailer light circuits to prompt activation of towing vehicle trailer circuits. The grounding component can be effectively integrated anywhere between the LED trailer lights and the towing vehicle plug connection, including but not limited to the towing vehicle plug, the trailer plug or an adapter between these two plugs. Regardless of placement, the grounding component can be applied to any or all of the lighting circuits, whatever is necessary to prompt operation of a particular towing vehicle's towing circuits.

Figure 2:
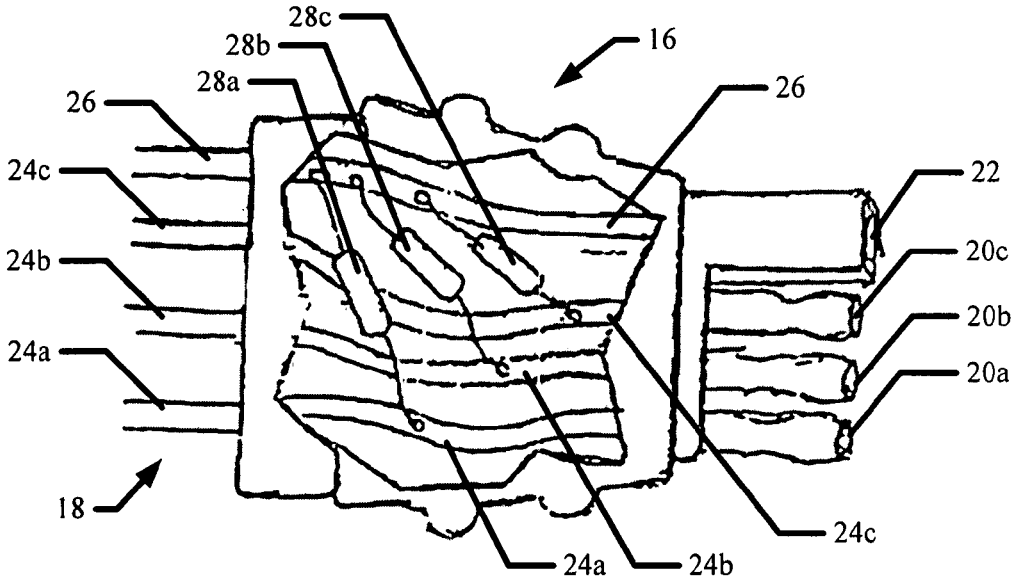
FIG. 2 depicts a 4-pin flat trailer harness plug according to one embodiment of the present invention, which has resistors in the plug coupled between each of the trailer light circuits and ground.

FIG. 2 shows an exemplary embodiment of a 4-pin flat trailer harness plug 16 according to the present invention. The trailer harness plug 16 includes three lighting circuit pins 20*a*, 20*b*, 20*c* and a ground pin receptacle 22 and is configured to mate with a standard 4-pin flat towing vehicle plug connected to a towing vehicle harness (not shown). Each of the lighting circuit pins 20*a-c* is connected to a corresponding lighting circuit wire 24*a-c* of a trailer electrical harness 18. The ground pin receptacle 22 is connected to a ground wire 26 in the trailer electrical harness 18. Each of the lighting circuit wires 24*a-c* is connected to a lighting circuit of the trailer (not shown) for one of the tail lamp, right turn lamp and left turn lamp. The ground wire 26 is grounded to the trailer frame. In the trailer harness plug 16, one of resistors 28*a*, 28*b*, 28*c* is coupled between each of the lighting circuit wires 24*a*, 24*b*, 24*c* and the ground wire 26, thereby providing a resistive path to ground from each lighting circuit wire 24*a-c* to ground.

Figure 3:
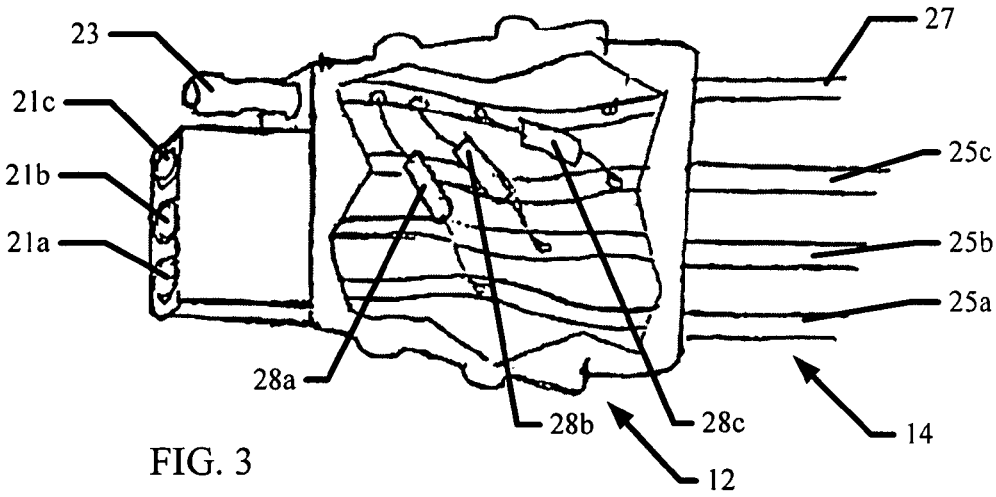
FIG. 3 depicts a 4-pin flat a towing vehicle plug according to a second embodiment of the invention, which has resistors coupled between each of the trailer light circuits and ground.

FIG. 3 shows an exemplary embodiment of a 4-pin flat towing vehicle plug according to the invention. The towing vehicle plug 12 includes three lighting circuit pin receptacles 21*a*, 21*b*, 21*c* and a ground pin 23 and is configured to mate with a standard 4-pin flat trailer harness plug connected to a trailer electrical harness (not shown). Each of the lighting circuit pin receptacles 21*a-c* is connected to a corresponding energizing circuit wire 25*a-c* of a towing vehicle electrical harness 14. The ground pin 23 is connected to a ground wire 27 in the towing vehicle electrical harness 14. Each of the energizing circuit wires 25*a-c* is connected to a light energizing circuit of the towing vehicle (not shown) for energizing one of the tail lamp, right turn lamp and left turn lamp of the trailer. The ground wire 27 is grounded to the towing vehicle frame. In the towing vehicle harness plug 12, one of resistors 28*a*, 28*b*, 28*c* is coupled between each of the energizing circuit wires 25*a*, 25*b*, 25*c* and the ground wire 27, thereby providing a resistive path to ground from each energizing circuit wire 25*a-c* to ground. In this configuration, these resistive ground paths are also provided between the towing vehicle lighting circuits and ground when the towing harness plug 12 is connected to a corresponding trailer harness plug.

Figure 4:
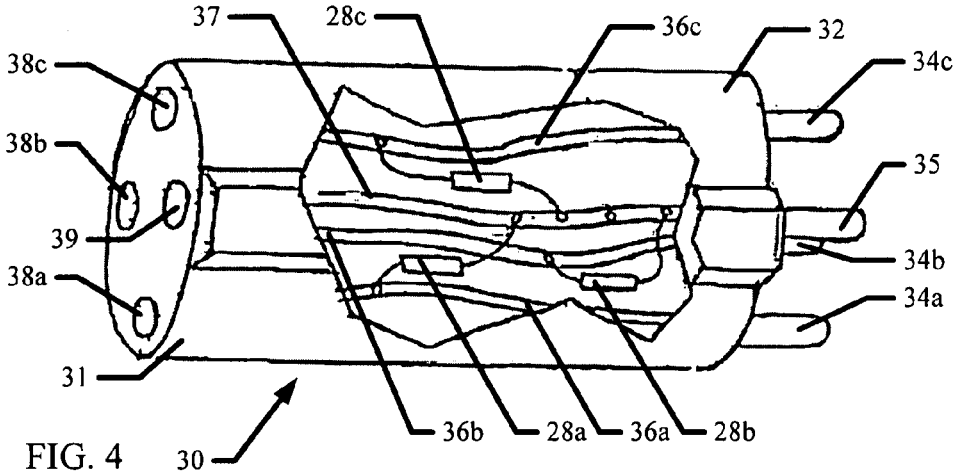
FIG. 4 depicts a 4-pin to 4-pin straight adapter for round harness plugs according to a third embodiment of the invention, which has resistors coupled between each of the trailer light circuits and ground.

FIG. 4 shows an exemplary embodiment of a plug adapter according to the present invention. The plug adaptor 30 is a straight 4-pin to 4-pin adapter for coupling round harness plugs. The adapter 30 has a female end 31 and male end 32. The male end 32 is configured to mate with a corresponding towing vehicle harness plug (not shown) and the female end 31 is adapted to mate with a corresponding trailer harness plug (not shown). Adapter pins 34*a*, 34*b* and 34*c* and a ground pin 35 are disposed in the adapter male end 32. Each of the pins 34*a*, 34*b* and 34*c* is connected to a corresponding connecting wire 36*a-c*, each of which is in turn connected to one of pin receptacles 38*a*, 38*b*, 38*c* disposed in the adapter female end 31. The ground pin 35 is connected to a ground lead 37, which in turn is connected to a ground pin receptacle 39 disposed in the adapter female end 31. A resistor 28*a-c* is coupled between each of the connecting wires 36*a-c* and the ground lead 37 to provide the resistive path to ground from each connecting wire 36*a-c* to ground. In this configuration, these resistive ground paths are also provided between the towing vehicle lighting circuits and ground when the adapter 30 is connected between a towing vehicle harness plug and a trailer harness plug.

Figure 5:
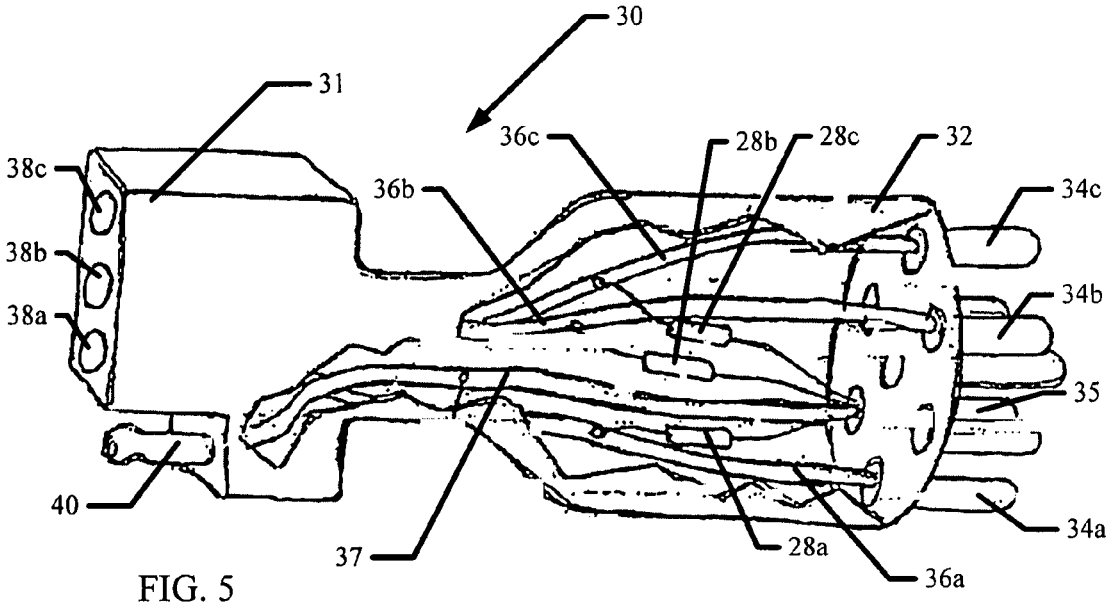
FIG. 5 depicts a 7-round to 4-flat adapter according to a fourth embodiment of the invention, which has resistors coupled between each of the trailer light circuits and ground.

FIG. 5 shows an exemplary embodiment of a 7-round to 4-flat adapter according to the present invention. The adapter 30 has a female end 31 and male end 32. The male end 32 is configured to mate with a 7-pin round towing vehicle plug (not shown) and the female end 31 is adapted to mate with a 4-pin flat trailer harness plug (not shown). Adapter pins 34*a*, 34*b* and 34*c* and a ground pin 35 are disposed in the adapter male end 32. Each of the pins 34*a*, 34*b* and 34*c* is connected to a corresponding connecting wire 36*a-c*, each of which is in turn connected to one of pin receptacles 38*a*, 38*b*, 38*c* disposed in the adapter female end 31. The ground pin 35 is connected to a ground lead 37, which in turn is connected to a ground pin 40 disposed in the adapter female end 31. A resistor 28*a-c* is coupled between each of the connecting wires 36*a-c* and the ground lead 37 to provide the resistive path to ground from each connecting wire 36*a-c* to ground. In this configuration, these resistive ground paths are also provided between the towing vehicle lighting circuits and ground when the adapter 30 is connected between a towing vehicle harness plug and a trailer harness plug.

Figure 6:
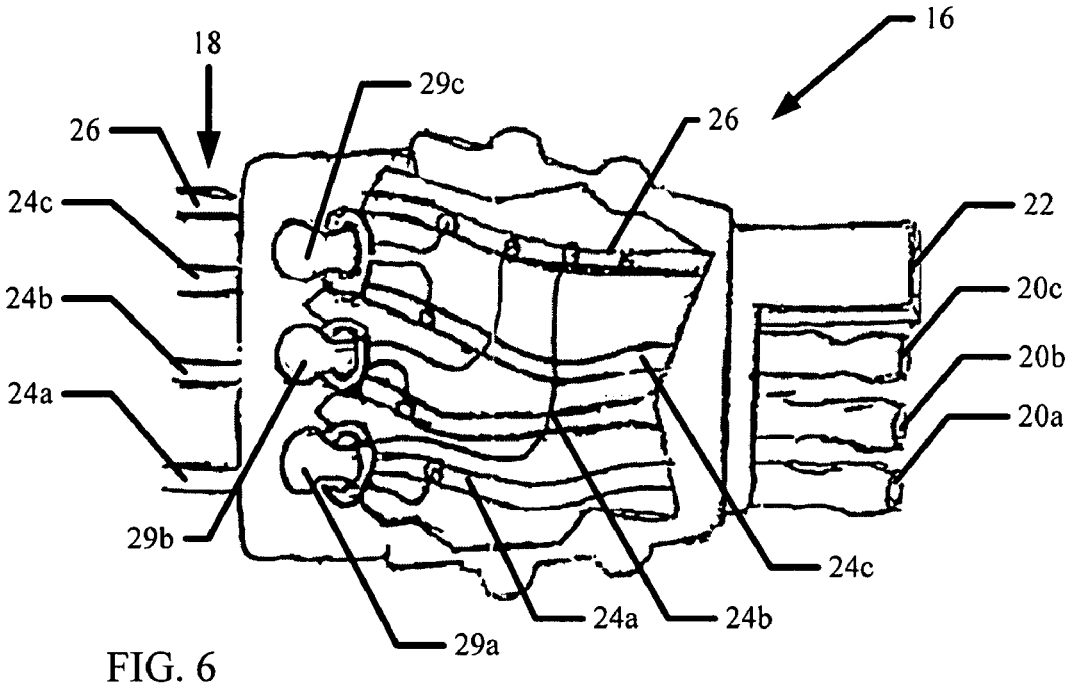
FIG. 6 depicts a 4-pin flat trailer harness plug according to a fifth embodiment of the present invention, which has incandescent lights in the plug coupled between each of the trailer light circuits and ground.

FIG. 6 shows another embodiment of a 4-pin flat trailer harness plug 16 according to the present invention, which has incandescent lights in the plug coupled between each of the trailer light circuits and ground. The trailer harness plug 16 of FIG. 6 is similar to that shown in FIG. 2, except that the trailer plug 16 has one of incandescent lights 29*a*, 29*b*, 29*c* coupled between each of the lighting circuit wires 24*a*, 24*b*, 24*c* and the ground wire 26.

Figure 7:
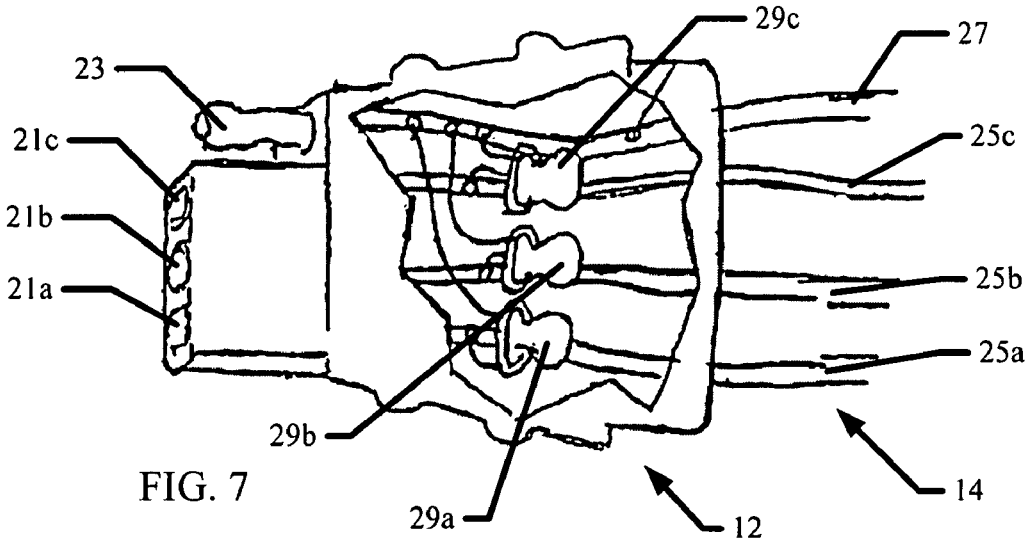
FIG. 7 depicts a 4-pin flat a towing vehicle plug according to a sixth embodiment of the invention, which has incandescent lights coupled between each of the trailer light circuits and ground.

FIG. 7 shows another embodiment of a 4-pin flat towing vehicle plug according to the invention, which has incandescent lights coupled between each of the trailer light circuits and ground. The towing vehicle plug 12 of FIG. 7 is similar to that shown in FIG. 3, except that the towing vehicle plug 12 has one of incandescent lights 29*a*, 29*b*, 29*c* coupled between each of the energizing circuit wires 25*a*, 25*b*, 25*c* and the ground wire 27.

Figure 8:
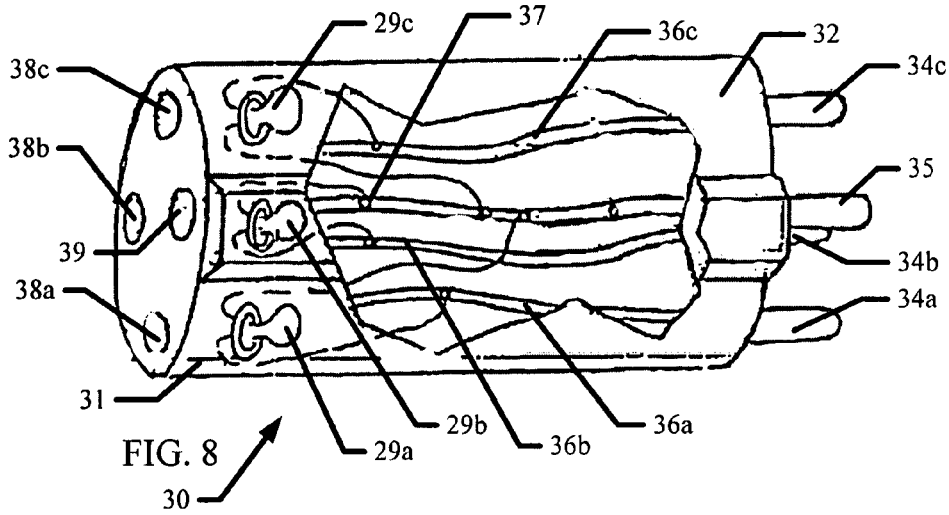
FIG. 8 depicts a 4-pin to 4-pin straight adapter for round harness plugs according to a seventh embodiment of the invention, which has incandescent lights coupled between each of the trailer light circuits and ground.

FIG. 8 shows another embodiment of a 4-pin to 4-pin straight adapter for round harness plugs according to the present invention, which has incandescent lights coupled between each of the connecting wires and ground. The adapter of FIG. 8 is similar to that shown in FIG. 4, except that the adapter includes incandescent lights 29*a*, 29*b*, 29*c* coupled between each of the connecting wire 36*a-c* and the ground lead 37.

Figure 9:
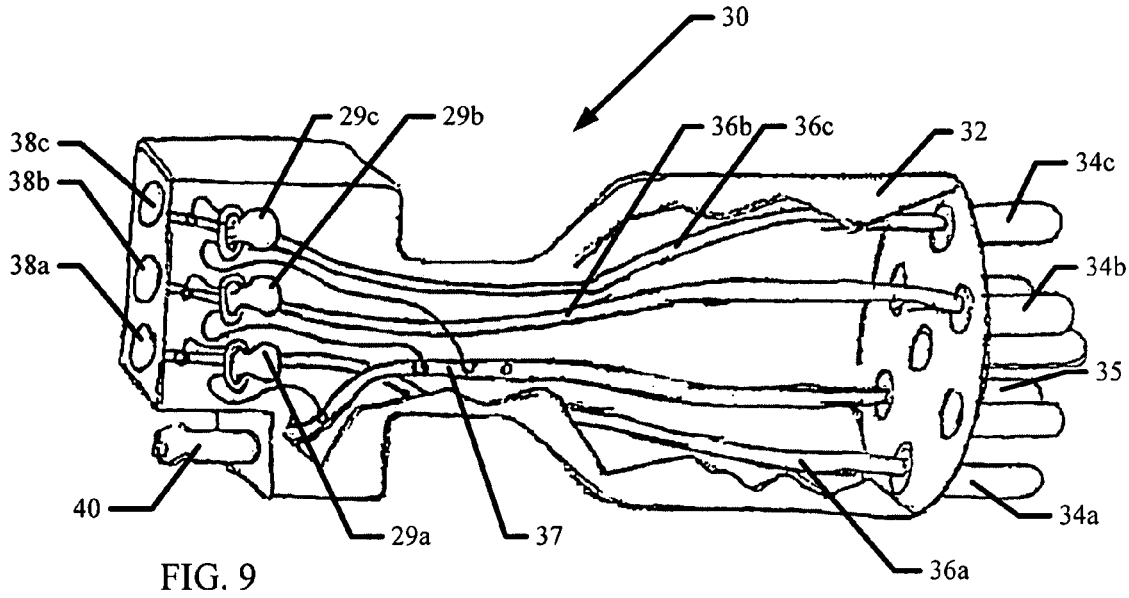
FIG. 9 depicts a 7-round to 4-flat adapter according to a eighth embodiment of the invention, which has incandescent lights coupled between each of the trailer light circuits and ground.

FIG. 9 depicts another embodiment of a 7-round to 4-flat adapter according to the present invention, which has incandescent lights coupled between each of the connecting wires and ground. The adapter of FIG. 9 is similar to that shown in FIG. 5, except that the adapter includes incandescent lights 29*a*, 29*b*, 29*c* coupled between each of the connecting wires 36*a-c* and the ground lead 37.

From the foregoing, it can be seen that the apparatus of the present invention possesses numerous advantages. It allows towing vehicles not presently compatible with LED trailer lights to provide normal operational interface with trailers having LED lights. The grounding component can be applied to any or all of the lighting circuits, whatever is necessary to prompt operation of a particular towing vehicle's towing circuits. The resistive grounding component can be effectively integrated in any convenient location between the LED trailer lights and the towing vehicle plug connection Upon reading this disclosure, those skilled in the art will appreciate that various changes and modifications may be made to the preferred embodiments of the invention and that such changes and modifications may be made without departing from the spirit of the invention. For example, resistive elements other than a resistor or an incandescent lamp may be used. Therefore, the invention in its broader aspects is not limited to the specific details, representative devices, and illustrative examples shown and described. Accordingly, departures may be made from such details without departing from the spirit or scope of the general inventive concept.

What is claimed is:

1. An apparatus for coupling a trailer lighting circuit including a light emitting diode to a towing vehicle energizing circuit, the apparatus comprising:

a connector having a first contact for coupling to an input to the trailer lighting circuit and a second contact for coupling to an electrical ground;

wherein the connector includes a resistive component connected directly between the first contact and the second contact;

wherein the connector is configured to couple the first contact to an output of the towing vehicle energizing circuit; and wherein the light emitting diode of the trailer lighting circuit connected directly between the input to the trailer lighting circuit and the electrical ground allows the towing vehicle energizing circuit to energize the trailer lighting circuit.

2. The apparatus of claim 1 wherein the resistive component comprises a resistor.

3. The apparatus of claim 1 wherein the resistive component comprises an incandescent light.

4. The apparatus of claim 1 wherein the connector comprises a trailer harness plug.

5. The apparatus of claim 1 wherein the connector comprises a towing vehicle harness plug.

6. The system of claim 1 wherein the connector comprises an adapter configured for coupling a towing vehicle electrical harness plug to a trailer electrical harness plug.

7. An apparatus for coupling a towing vehicle electrical harness to a trailer electrical harness that is coupled to a trailer light having an LED, the apparatus comprising:

connector means for electrically coupling the towing vehicle electrical harness to the trailer electrical harness;

wherein the connector means includes a resistive component that is connected directly between a ground and in parallel with the trailer light having the LED connected directly to the ground when the connector means is coupled to the towing vehicle electrical harness so that the towing vehicle electrical harness can energize the trailer light having the LED.

8. The apparatus of claim 7 wherein the resistive component comprises a resistor.

9. The apparatus of claim 7 wherein the resistive component comprises an incandescent light.

10. The apparatus of claim 7 wherein the connector comprises a trailer harness plug.

11. The apparatus of claim 7 wherein the connector comprises a towing vehicle harness plug.

12. The system of claim 7 wherein the connector comprises an adapter configured for coupling the towing vehicle electrical harness to the trailer electrical harness.

13. An apparatus for coupling a towing vehicle energizing circuit for energizing an incandescent trailer light to a light emitting diode on a trailer, the apparatus comprising:

a connector for electrically coupling the towing vehicle energizing circuit to the light emitting diode;

wherein the connector has a first terminal for connecting to an electrical ground, a second terminal for connecting directly to the light emitting diode and a resistive component connected directly between the first terminal and the second terminal; and wherein the incandescent trailer light is electrically coupled between the first connector terminal and the second connector terminal when the connector is coupled to the light emitting diode so that the towing vehicle energizing circuit can energize the incandescent trailer light.

14. The apparatus of claim 13 wherein the resistive component comprises a resistor.

15. The apparatus of claim 13 wherein the resistive component comprises an incandescent light.

16. The apparatus of claim 13 wherein the connector comprises a trailer harness plug.

17. The apparatus of claim 13 wherein the connector comprises a towing vehicle harness plug.

18. The system of claim 13 wherein the connector comprises an adapter configured for coupling the towing vehicle electrical harness to the trailer electrical harness.

* * * * *